US005782494A

United States Patent [19]

Crandall et al.

[11] Patent Number: 5,782,494

[45] Date of Patent: Jul. 21, 1998

[54] DESKTOP PRINTER NOTES

[75] Inventors: Michael D. Crandall, North Oaks; Kim K. Tsujimoto, New Brighton; Mark S. Vogel, Maplewood, all of Minn.

[73] Assignee: Minnesota Mining and Manufacturing Company, St. Paul, Minn.

[21] Appl. No.: 636,615

[22] Filed: Apr. 23, 1996

Related U.S. Application Data

[63] Continuation-in-part of Ser. No. 574,675, Dec. 19, 1995.

[51] Int. Cl.[6] ..... B42D 1/00

[52] U.S. Cl. ..... 281/2; 281/5; 281/9; 281/12; 462/2; 462/26; 283/62; 283/101; 283/61

[58] Field of Search ..... 281/2, 5, 9, 12; 462/2, 26; 283/61, 62, 101

[56] References Cited

U.S. PATENT DOCUMENTS

| | | | |
|---|---|---|---|
| H377 | 12/1987 | Greig | 281/2 |
| 2,215,995 | 9/1940 | Bellack | 281/2 X |
| 3,691,140 | 9/1972 | Silver | 260/78.5 |
| 4,587,152 | 5/1986 | Gleichenhagen et al. | 428/195 |
| 4,599,265 | 7/1986 | Esmay | 428/355 |
| 4,680,210 | 7/1987 | Corcoran | 428/42 |
| 4,930,812 | 6/1990 | Howard | 281/5 |
| 4,971,364 | 11/1990 | Templet | 283/61 X |
| 4,980,212 | 12/1990 | Marquis et al. | 283/101 X |
| 4,995,641 | 2/1991 | Landry et al. | 281/2 X |
| 5,011,186 | 4/1991 | Bodziak et al. | 281/12 |
| 5,029,903 | 7/1991 | Pennock | 281/5 X |
| 5,087,223 | 2/1992 | Kaluza | 462/2 |
| 5,299,833 | 4/1994 | Madole | 281/2 |
| 5,324,078 | 6/1994 | Bane | 281/2 X |
| 5,328,409 | 7/1994 | Marquardt | 287/2 X |
| 5,370,420 | 12/1994 | Khatib et al. | 283/81 |
| 5,399,403 | 3/1995 | Instance | 281/2 X |
| 5,418,026 | 5/1995 | Dronzek, Jr. et al. | 428/40 |

FOREIGN PATENT DOCUMENTS

| | | |
|---|---|---|
| 0 607 955 A1 | 1/1994 | European Pat. Off. . |
| 2280659 | 2/1995 | United Kingdom . |
| WO 92/21119 | 11/1992 | WIPO . |
| WO 94/07228 | 3/1994 | WIPO . |
| WO 94/11202 | 5/1994 | WIPO . |

*Primary Examiner*—Daniel W. Howell
*Assistant Examiner*—Adesm Bhargava
*Attorney, Agent, or Firm*—Carolyn V. Peters

[57] ABSTRACT

A printer note construction consisting of repositionable adhesive coated (discontinuously) substrates removably affixed onto a backsheet, such that the construction can pass through a personal computer printer without damage to the printer or to the article (wrinkling, tearing, folding, releasing, etc.). Typically, this construction would be pre-assembled and packaged in a manner similar to point of sale label stock. Alternatively, a preprinted backsheet template wherein, repositionable notes (such as Post-it® brand notes) from a typical pad of notes, are aligned with the template markings and then run through a personal computer printer.

9 Claims, 3 Drawing Sheets

DESKTOP PRINTER NOTES

This is a continuation-in-part of U.S. patent application Ser. No. 08/574,675 filed Dec. 19, 1995, which is incorporated herein by reference.

TECHNICAL FIELD

This invention relates to a means for printing customized repositionable notes, using a desktop printer and an array of repositionable, printable articles, provided either as a pre-assembled article or as a article assembled by the user.

BACKGROUND OF THE INVENTION

Conventional materials that are said to be compatible with print devices are label materials that generally consist of a fully coated adhesive label with a release coated substrate. These materials are claimed to pass through the printer without dislodging or jamming the print device. In practice this may not always be true.

There seems to be a growing desire for customization and personalization in the office environment. In addition to this desire for customization, there seems to be a trend towards "on-demand" products (products that do not have to be stored, ordered in advance, etc., but are available on-demand). Various label stock constructions have long been available that allows someone to customize mailing and/or shipping labels.

For example, label construction with release liner wider than label layer was recently disclosed in U.S. Pat. No. 5,370,420. The fully coated permanent adhesive label must have a dimension narrower than the release liner to avoid contamination of the printer with adhesive.

A printable permanent adhesive label which has outdoor durability is disclosed in WO 92/21119. This document describes a multilayer construction with a vinyl label layer adhered to a substrate with a release coating and a moisture barrier. The latter is to control the curl of the substrate layer by control of the moisture content via the moisture barrier layer. Without this layer the construction is said to result in significant curl and subsequent delamination of label causing printer jamming.

In U.S. Pat. No. 5,418,026 a printable label construction is described that comprises at least three layers, two of which are permanently adhered together to control the curl of the construction when passed through a printing device that applies heat to the construction.

In GB 2 280 659A a printable article is described that must have at least the a layer of adhesive around the perimeter of the label. An alternative method is to have a fully coated layer of adhesive on one of the surfaces of the article.

In the office environment, the needs for increased productivity, professional image and personal image (creativity) are growing. Oftentimes office workers will need to communicate the same message to multiple people, or make sure numbers are accurate and legible (productivity issues), or have neat, legible, professional-looking memos and notes (professional image issue), or have their personality "shine through" in their correspondence (personal image issue). Being able to create and produce printed notes at one's desktop computer and printer, would meet these, and other, needs.

However, that has been a problem to date because to personalize repositionable notes, unlike labels, a request was made and that request was sent to a commercial printing business. Generally large quantities of the same kind of design were needed to make such an order cost effective. However, recent developments have permitted smaller print shops or copy shops to customize and personalize a smaller quantity of product in a short period of time. But what was really missing was the ability to personalize and customize repositionable notes, with the same convenience as label stock.

Thus it was against this background that the present invention was developed.

SUMMARY OF THE INVENTION

Briefly, in aspect of the present invention, a printer note construction is provided consisting of repositionable adhesive coated (discontinuously) substrates removably affixed onto a backsheet, such that the construction can pass through a personal computer printer without damage to the printer or to the article (wrinkling, tearing, folding, releasing, etc.). Typically, this construction would be pre-assembled and packaged in a manner similar to point of sale label stock.

Alternatively, a preprinted backsheet template is provided wherein, repositionable notes (such as POST-IT brand notes) from a typical pad of notes, are aligned with the predetermined template markings and then run through a personal computer printer. The user assembles the article by combining the preprinted backsheet template and at least one repositionable note aligned to coincide with the predetermined markings on the preprinted backsheet template.

The present invention provides for an array of repositionable, printable articles removably adhered on a backsheet in a manner suitable for printing wherein the repositionable, printable articles are removably attached by means of a pressure sensitive adhesive, wherein the pressure sensitive adhesive is applied to at least a single portion of the one surface of each article but to no more than three sides of each article, further the adhesive portion may be a continuous or discontinuous pattern.

Typically, the repositionable, printable articles are coated with an adhesive configured as a stripe that runs parallel to the leading edge of the backsheet, such as a typical repositionable note. However, other configurations contemplated include several stripes of adhesive, either parallel to each other or perpendicular to each other. The stripe may be set-back from the edge and/or may be discontinuous, rather than continuous.

Advantageously, the present invention will permit someone to print the same message to multiple people, while personalizing the greeting, or make sure numbers are accurate and/or text is legible (productivity issues), or have neat, legible, professional-looking or humorous memos, and notes, or have their personality "shine through" in their correspondence. Being able to create and produce printed notes at one's desktop computer and printer, would meet these, and other, needs.

With the present invention printing is easy and can be reliably applied to the backsheet material since it is very similar to plain paper and not a low adhesion liner material.

Some present label materials have printing on the backside of the liner material (the side not coated with the low adhesion material) to identify the manufacturer, however none are seen to have a printing on the top surface. With the present invention any directions, artwork, etc., will be visible to the user.

DESCRIPTION OF THE PREFERRED EMBODIMENT(S)

In one embodiment printer note constructions are pre-assembled to provide one or more repositionable adhesive notes (such as POST-IT brand notes) of a certain size and color, on a backsheet, similar to a sheet of labels that are meant to be sheet-fed through a printer. Unlike typical labels, however, the backsheet does not need to be a surface coated with a low-energy material, but rather can be standard bond paper.

Additional anchoring methods can be used to help anchor the notes to the backsheet as they travel through the printing device, although such additional anchoring is optional. These additional anchoring devices could be areas of low-tack adhesive on the backsheet to temporarily hold down the non-adhesive portions of the notes, and/or areas of a film or other substrate on the backsheet to which the repositionable adhesive holds more aggressively, and/or additional stripes of adhesive on the notes themselves and/or rounded corners on the notes.

Figure 2:
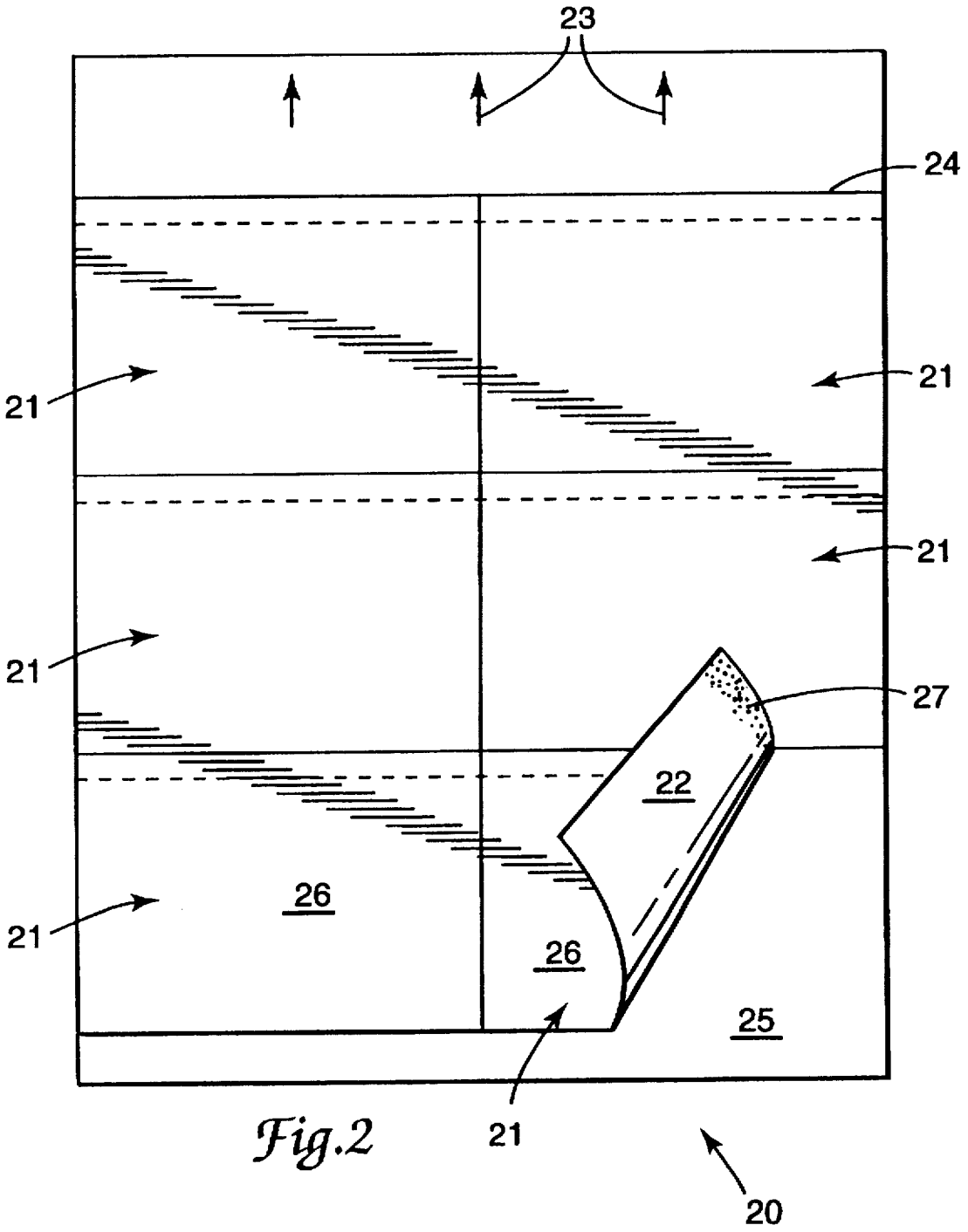
FIG. 2 is a perspective view of a pre-assembled printer note construction.

Referring to FIG. 2, pre-assembled note constructions (20) comprise notes (21) are assembled onto specific locations on a backsheet (25). These locations on backsheet (25) would correspond to locations on a software template wherein the end-user could compose/create their customized note. Ready-to-print note sheets (20) (that is the pre-assembled constructions) are inserted into a printer (either in the standard cartridge or in the single sheet bypass feeder), such that the leading edge of the pre-assembled construction (20) is positioned in the printer with arrows (23) pointing in the direction appropriate for the specific printer selected. The notes (21) have a front surface (26), the surface used for printing, and a back surface (22). Generally, the notes (21) are coated with an adhesive stripe along the upper edge of the back surface (22) of the notes (21). The bottom portion of the note (21) is left free of an adhesive stripe.

When the composed information in the software template is printed onto the ready-to-print note sheet, the end-user can remove the notes from the note sheet after it exits the printer, and use it as a standard repositionable note. A particular useful method of constructing the pre-assembled note constructions is to laminate a backsheet with a sheet that has been coated with adhesive stripes in a predetermined pattern. Once this laminate is constructed, the notes are created by running the laminate through a die-cutter, wherein the top sheet of the laminate (that is, the printable note sheet) is cut into usable sizes, such as 3"×4" and the like.

Figure 1:
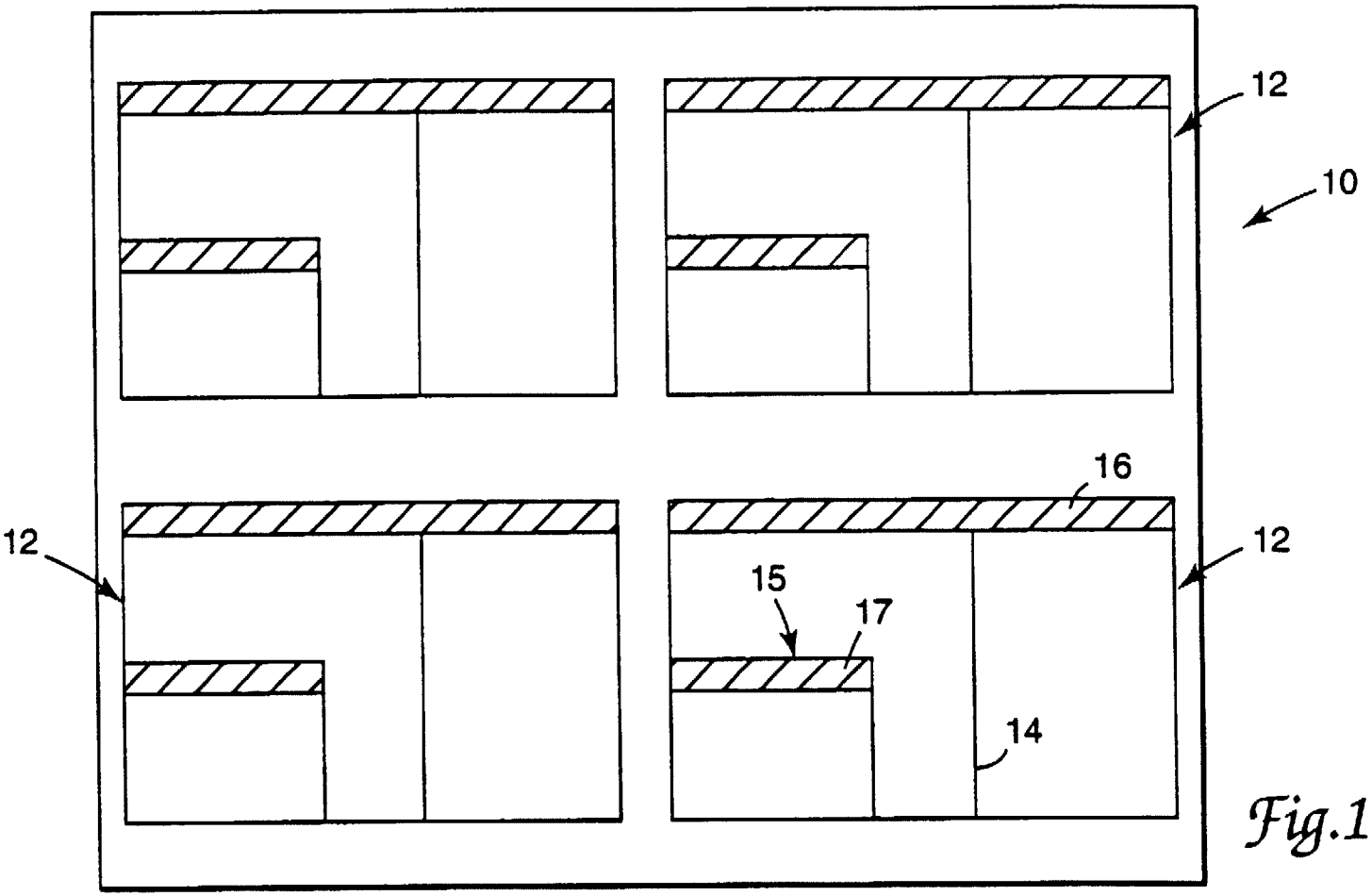
FIG. 1 is a schematic view of user-assembled printer note construction template.

Referring now to FIG. 1, an alternative embodiment is provided wherein, a pre-printed backsheet template (10) can be used to prepare printer ready articles. Using such a backsheet template (10), commercially available repositionable notes (not shown), such as those readily available under the trade name of POST-IT Notes can be removably applied to the backsheet template (10) at positions premarked (for example, notes designated by 12, 14, 15) on the backsheet template (10), wherein the adhesive stripe on the commercially available respositionable notes is positioned onto the portion of the template designated as 16, 17. The user-constructed sheets are then fed into a printer in the same fashion as pre-assembled ready-to-print note constructions. This is a particularly advantageous means for providing for ready to print note constructions because, a variety of sizes could be used simultaneously. Various colors on a single sheet could also be used simultaneously. Furthermore, various configurations of notes can be provided depending on the design and layout of the template provided.

Repositionable notes stay secure on a bond paper backsheet, which may or may not be coated, when passed the majority of printers commercially available for end-users. However, additional anchorage may be needed for some printers. Additional anchorage may be used to alleviate concerns about printer jamming and notes falling off as the note sheet travels through the printer path, if the adhesive is such that a very light bond is obtained between the backsheet and the repositionable note.

Figure 3A:
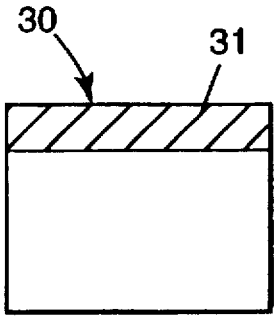
FIGS. 3*a*–3*i* are schematic views of various configurations of adhesive stripes as applied to printer notes.
Figure 3B:
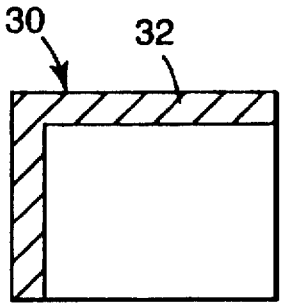
Figure 3C:
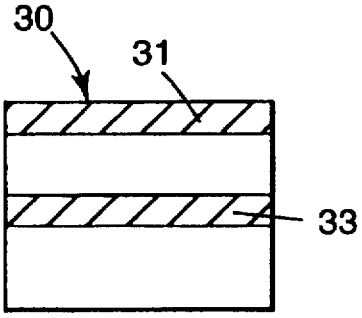
Figure 3D:
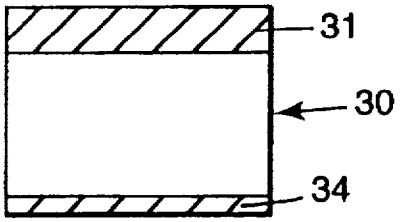
Figure 3E:
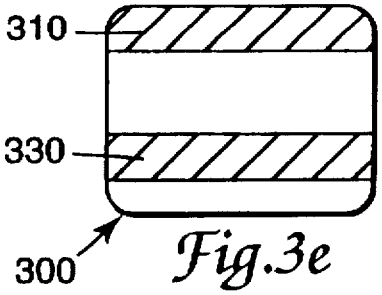
Figure 3F:
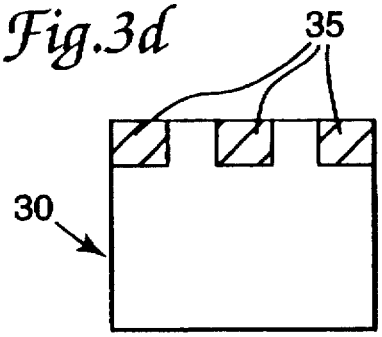
Figure 3G:
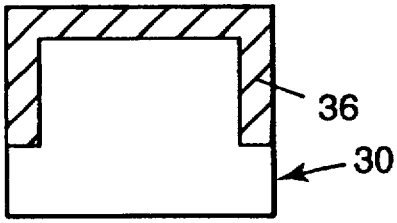
Figure 3H:
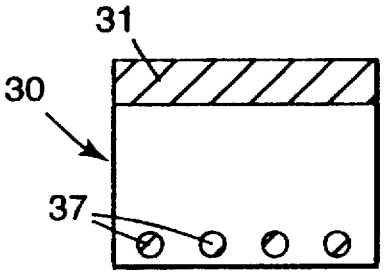
Figure 3I:
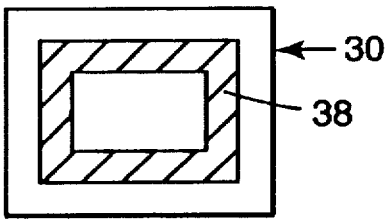

Different adhesive stripe orientations have been considered. However, for ease of use, as well as familiarity of use, at least one edge of the repositionable note is left uncoated. Preferably, there is only a single stripe of adhesive and preferably the location of the single stripe of adhesive is along the edge parallel to the leading edge of the backsheet. Referring to FIGS. 3*a*–3*i*, several of these stripe orientations have been illustrated. For example referring to FIG. 3*a*, the adhesive stripe (31) on the back side of note (30) is located along the upper edge of the note. This is typical configuration and is the configuration used on commercially available repositionable notes, such as Post-it® brand notes. FIG. 3*b* shows an adhesive stripe (32) that is positioned along the upper edge and one of the side edges (it could be on either side edge). FIGS. 3*c* and 3*d* show a pair of adhesive stripes, with a single stripe along the upper edge (31) and a second stripe (33) positioned further down the sheet such that there is a small but distinct separation or wherein one stripe (31) is along the upper edge and another stripe (34) is along the lower edge. FIG. 3*e* is illustrative of the ability to use different paper shapes, such as the note (300) wherein the corners are rounded and configured to have two stripes of adhesive (310 and 330). Furthermore, the present invention is neither limited by the geometric shape of the note paper, nor the position of the adhesive stripe provided the adhesive stripe does not encompass the entire back surface of the note or the outside periphery of the note. However, various other configurations, such as those shown in FIGS. 3*f* to 3*i* could be consideration to be within the scope of the invention, wherein FIG. 3*f* illustrates a "stripe" (35) that consists of a series of adhesive portions, in a patterned or non-patterned array, alternatively a patterned stripe (37), such as that shown in FIG. 3*h* could be combined with a single solid stripe (31) or even another patterned stripe. FIG. 3*g* illustrates a "stripe" (36) that is positioned along the upper edge of the note (30), as well as along at least a portion of two sides perpendicular to the upper edge of the note (30). Referring now to FIG. 3*i*, it would be within the scope of the have a note (30) with the adhesive "stripe" consisting of an adhesive portion (38), wherein the adhesive does not abut along the edges of the note, but rather is set back from the edges of the note, such that the edges of the note are free and not adheredly laminated to a backsheet.

While the configurations and embodiments shown in the Figures are illustrative of the invention, these illustrations are by no means an exhaustive list of possibilities. The way the adhesive coated articles are attached to the backing sheet is only an aesthetic design consideration. In the Figures, the adhesive stripe is shown as a singular or a double stripe. It is understood that the stripe can be as few as one and as many as desired, although for the preferred configuration is FIG. 3*a* for ease of handling. The location of the stripe(s) also is dependent on consumer preference and does not alter the functionality of printing the article.

Suitable materials for the backsheet or substrate layers for use in the present invention include, but are not limited to, paper, plastic films, cellulose acetate, ethyl cellulose, woven or nonwoven fabric formed of synthetic or natural materials, metal, metallized polymeric film, ceramic sheet material and the like. Generally, these layers are about 50 μm to about 155 μm in thickness, although thicker and thinner materials are not precluded. Materials should be such that passage through the printing device will not unduly damage the material. The preferred material for these ply layers is conventional bond paper. These layers may also be treated, if desired, with release coatings, priming layers and ink receptivity layers, such coatings being known to those skilled in the art and the coating thicknesses and coating conditions being those that are typical for such known coatings. For example it may be desirable to apply a release coating to the top side of the backing paper to lower the force required to remove the note layer. Similarly a priming layer may be used to enhance anchorage of the adhesive coat to the note layer. While any one or combination of these can be used it is not essential to the practice of the invention.

Optionally, the backsheet (25) can be printed with a company logo, product usage directions, product name, and the like. This printing can be either on the side of the backsheet to which the notes are removably adhered, or the opposite side. It is preferred that the printing be on the side of the backsheet to which the notes are removably adhered.

Applicable priming materials are those that are compatible with the type of adhesive being used. For example with acrylate adhesives zinc oxide or silica based materials, laminated polybutadiene and the like can be used. Such adhesive/priming material combinations are those known to those skilled in the art and the amounts, coating weights and thickness and types of combinations used are those that are consistent with a typical application as known to those in the art.

Ink receptivity enhancing layers may be a coating on the repositionable note such as an acrylic, polyester, or urethane polymer containing finely divided clay or silica, or calcium carbonate as examples.

Suitable release materials may be acrylates, urethanes, silicones, fluoropolymers and the like which are known in the art. When used, release materials are coated on the surface of backsheets that are in contact with notes. These are applied by the conventional methods known in the art, and at suitable coating weights to provide the desired release level. Particularly useful release materials are those that readily release from a layer of pressure sensitive adhesive and includes silicones, fluorocarbons, acrylates, urethanes, chrome complexes, grafted or block siloxane hydrocarbons, and blends of these materials.

Adhesives useful in this invention are those that exhibit repositionable, removable characteristics. Such adhesives may include microsphere-based adhesives, microparticle based adhesives, hot melt pressure sensitive adhesives, aerosol adhesives or the like. Some examples of particularly useful adhesives are those described in U.S. Pat. No. 3,691,140 which describes tacky, elastomeric copolymer microspheres; U.S. Pat. No. 4,599,265 which describes an ultraviolet light polymerized acrylate adhesive that does not exhibit adhesion build; and U.S. Pat. No. 4,587,152 which describes residuelessly redetachable contact-adhesive sheet-like structures, all of which are incorporated herein by reference. Any one or combination of adhesives may be used in this invention. Other materials that exhibit removable characteristics may also be used and are understood as being applicable to the article and within the scope of the invention described herein.

The adhesive can be coated on at least one major surface and may be comprised of at least one discontinuous stripe or continuous stripe, examples of which can be seen by referring to the FIGS. 3*a*–3*i*.

The printing devices used to test the invention include the two most common type of personal computer printers. These are electrophotographic types referred to as laser printers and ink jet printers. The latter work by applying the image to a photoconductor drum and then transferring the image to the substrate. The image on the article is then fused to the substrate by means of heat and pressure. The temperature of the heat applied in the fusing station is on the order of 400° F. although this temperature may vary from machine to machine and for the various manufacturers.

The inkjet functions by spraying an ink in the form of droplets onto the substrate. The image is not heated or fused in this case as the ink is liquid and wets the substrate.

Objects and advantages of this invention are further illustrated by the following examples, but the particular materials and amounts thereof recited in these examples, as well as other conditions and details, should not be construed to unduly limit this invention. All materials are commercially available or known to those skilled in the art unless otherwise stated or apparent.

EXAMPLES

General Example Description

A printer note sheet was constructed by laminating individual repositionable notes, approximately 3 inches×3 inches in size, made in the laboratory or commercially available, each note with one or two stripes of removable adhesive across the top of the note or across the top and bottom of the note or across the top and center of the note, to a non-coated sheet of standard 20# xerographic bond paper (8.5 inches×11 inches), such that 6–12 notes fit on a single piece of xerographic bond paper. Different adhesives and stripe locations were investigated, as described below.

Example 1

Repositionable notes, commercially available as POST-IT notes from 3M Company, St. Paul, Min. were obtained and used to construct Printer Note sheets as described in the General Example above. These notes had either a ¾" or 1⅛" wide stripe of adhesive across the top.

Notes with a 1 inch stripe of adhesive on the top of the note, and a ⅛" stripe of adhesive at the bottom of the note were made as described, from the same material used to make standard POST-IT notes; only the converting process was altered to obtain the bottom stripe of adhesive.

Example 2

Co-polymeric functional microspheres, as described in U.S. Ser. No. 08/174,620, were die-coated out of solvent onto 20# xerographic paper from Georgia Pacific that had been precoated with a silica-based primer on one side and a low energy release coating on the opposite side. The microspheres were coated onto the primer coating; the adhesive stripe was approximately ¾" in width. This material was converted into the repositionable notes that were constructed into the final printer note product as described above in the General Description.

Example 3

An adhesive formulation consisting of polymer microspheres as described in Example 1, an acrylic pressure-sensitive binder, a surfactant and a viscosifier, as described in U.S. Patent Application, Attorney's Docket No. 52032 USA 5A, filed Oct. 17, 1995 (Ser. No. 08/543,958) was transfer coated using an intermediate silicone belt, onto 20# Ashdown paper that had been precoated with a silica-based primer on one side and a low-release silicone-containing release coating on the opposite side. The microspheres were coated on the primer coating; the adhesive stripe was approximately 0.5" in width. This material was converted into the repositionable notes that were constructed into the final printer note product as described above in the General Example.

Example 4

Repositionable POST-IT Super Sticky Notes, commercially available from 3M Company, St. Paul, Min. were obtained. This product, which utilizes a microsphere adhesive formulation, was used to construct printer note sheets as described above in the General Example.

Example 5

Repositionable "eSeetac" notes, commercially available from Barton-Nelson Company were obtained. These notes are believed to have a rubber resin type adhesive that is hot-melt coated onto paper. Printer note sheets as described above in the General Example description were constructed from these commercially available notes.

Example 6

Repositionable "Memo Fix" notes, commercially available from Aero Company, v Savinjski Dolini, Slovenia were obtained. These notes are believed to have an adhesive consisting of 2-ethyl hexyl acrylate, coated on paper. Printer note sheets as described above in the General Example description were constructed from these commercially available notes.

Example 7

A repositionable glue stick, commercially available from 3M Company, St. Paul, Min. was obtained. This product, which utilizes a microsphere adhesive formulation was applied to 20# Ashdown paper in such as way that the product described in the General Example Description was constructed. The adhesive stripe on the final notes were approximately ¾" in width.

TEST RESULTS

The Printer note sheets described in the above examples were tested in two different types of printers: an Inkjet printer (Hewlett-Packard 1200C) and an electrophotographic printer (Hewlett-Packard Laserjet 4 Plus), through both the tray and the single sheet (bypass) feeder. A standard document with fill text was printed onto the Printer note sheet. Printer note sheets were checked for jamming, wrinkling, smearing/bleeding of the printer inks, etc. The results of these tests are shown below; an "OK" indicated that this example passed through the printer successfully.

| Example | Inkjet Tray | Laser Single Sheet | Laser Tray |
|---|---|---|---|
| Example 1 | OK | OK | OK |
| Example 2 | OK | OK | OK |
| Example 3 | OK | OK | OK |
| Example 4 | OK | OK | OK |
| Example 5 | OK | OK | OK |
| Example 6 | OK | OK | OK |
| Example 7 | OK | OK | OK |

Example 1 was further tested in several additional printers and the results are shown in the Table below:

| Printer Maker | Printer Style | Top Stripe Bypass | Top Stripe Tray Fed | Two Stripe Bypass | Two Stripe Tray Fed |
|---|---|---|---|---|---|
| Hewlett-Packard | 500 | na | OK | na | OK |
| Hewlett-Packard | Laserjet II | na | OK | na | OK |
| Hewlett-Packard | Laserjet IIID | OK | OK | OK | OK |
| Hewlett-Packard | Laserjet 4Si | NO | NO | OK | OK |
| Hewlett-Packard | Laserjet 4+ | OK | OK | OK | OK |
| Hewlett-Packard | 1200C | na | OK | na | OK |
| Hewlett-Packard | Deskwriter | na | OK | na | OK |
| Apple | Laserwriter Pro | OK | OK | OK | OK |

na = non applicable because bypass tray does not exist on this model.

Various modifications and alterations of this invention will become apparent to those skilled in the art without departing from the scope and principles of this invention, and it should be understood that this invention is not to be unduly limited to the illustrative embodiments set forth hereinabove. All publications and patents are incorporated herein by reference to the same extent as if each individual publication or patent was specifically and individually indicated to be incorporated by reference.

What is claimed:

1. A personal computer printer note construction consisting at least one printer note coated with a repositionable adhesive, wherein the printer note is removably affixed onto a backsheet by means of at least one stripe of repositionable adhesive along at least one edge or parallel to at least one edge of the printer note but not more than three edges of the printer note, such that the construction passes through a personal computer printer without damage to the printer or to the printer note construction.

2. The printer note construction according to claim 1 wherein the repositionable adhesive is a microsphere-based pressure sensitive adhesive.

3. The printer note construction according to claim 1 wherein the adhesive stripe is positioned along a single edge, wherein the single edge is parallel to the leading edge of the backsheet.

4. The printer note construction according to claim 1 wherein the adhesive is not along the edges of the note, but rather is set back from the edges of the note, such that the edges of the note are free and not adheredly laminated to the backsheet.

5. The printer note construction according to claim 1 wherein the backsheet is printed on the side to which the removably adhered notes are attached.

6. A preprinted personal computer printer backsheet template wherein, repositionable notes having a stripe of adhesive along at least a single edge of each note but not more than three edges taken from a pad of repositionable notes, are aligned with predetermined template markings and then passed through a personal computer printer.

7. The preprinted backsheet template according to claim 6 wherein the repositionable notes have a stripe of adhesive along a single edge of each note.

8. The preprinted backsheet template according to claim 6 wherein the repositionable notes have a stripe of pressure sensitive adhesive.

9. A user-assembled article comprising a preprinted backsheet template according to claim 6 and at least one repositionable note aligned to coincide with predetermined markings on the preprinted backsheet template.

* * * * *

UNITED STATES PATENT AND TRADEMARK OFFICE

CERTIFICATE OF CORRECTION

PATENT NO.: 5,782,494

DATED: July 21, 1998

INVENTOR(S): Michael D. Crandall, Kim K. Tsujimoto, Mark S. Vogel

It is certified that error appears in the above-identified patent and that said Letters Patent is hereby corrected as shown below:

Col. 4, lines 54 and 55 replace: "Referring now to FIG. 3*i*, it would be within the scope of the have a note (30) with the adhesive" with – Referring now to FIG. 3*i*, it would be within the scope of the invention to have a note (3) with the adhesive --

Signed and Sealed this

Twenty-first Day of March, 2000

*Attest:*

*Attesting Officer*

Q. TODD DICKINSON

*Commissioner of Patents and Trademarks*